US005531631A

United States Patent [19]

Judge

[11] Patent Number: 5,531,631

[45] Date of Patent: Jul. 2, 1996

[54] MICROFINISHING TOOL WITH AXIALLY VARIABLE MACHINING EFFECT

[75] Inventor: Edward E. Judge, Lansing, Mich.

[73] Assignee: Industrial Metal Products Corporation, Lansing, Mich.

[21] Appl. No.: 234,170

[22] Filed: Apr. 28, 1994

[51] Int. Cl.[6] ..... B24B 49/00

[52] U.S. Cl. ..... 451/5; 451/8; 451/49; 451/168

[58] Field of Search ..... 451/5, 8, 49, 62, 451/168, 173

[56] References Cited

U.S. PATENT DOCUMENTS

| | | | |
|---|---|---|---|
| 4,505,070 | 3/1985 | Schwär | 451/173 |
| 4,519,170 | 5/1985 | Thielenhaus | 451/173 |
| 4,682,444 | 7/1987 | Judge et al. . | |
| 4,993,191 | 2/1991 | Judge et al. | 451/303 |
| 5,095,663 | 3/1992 | Judge et al. . | |
| 5,148,636 | 9/1992 | Judge et al. . | |
| 5,311,704 | 5/1994 | Barton, II et al. . | |

*Primary Examiner*—Maurina T. Rachuba
*Attorney, Agent, or Firm*—Harness, Dickey & Pierce

[57] ABSTRACT

A microfinishing machine particularly adapted for microfinishing external cylindrical surfaces such as found on internal combustion engine crankshaft bearing journal. The machine includes a microfinishing tool assembly which presses an abrasive coated film against the workpiece and a gaging tool assembly which enables in-process diameter measurements to be made. The microfinishing tool assembly features means for shifting the center of pressure exerted on the abrasive coated film along the axial surface of the cylindrical surface being machined. Such adjustment can be achieved by shifting the pivot axis of the tool or by exerting an external torsional load onto the tool. The microfinishing tool assembly according to this invention allows axial form errors such as tapering of journal surfaces to be corrected in the microfinishing operation.

20 Claims, 6 Drawing Sheets

MICROFINISHING TOOL WITH AXIALLY VARIABLE MACHINING EFFECT

BACKGROUND AND SUMMARY OF THE INVENTION

This invention relates to machine tools and specifically to tools and machining methods for microfinishing cylindrical workpieces such as crankshaft journals to a high degree of precision.

Numerous types of machinery components must have finely controlled surface finishes in order to perform satisfactorily. For example, surface finish control, also referred to as microfinishing, is particularly significant in relation to the manufacturing of bearing journals such as are found in internal combustion engine crankshafts, camshafts and power transmission shafts. For journal type bearings, very accurately formed cylindrical surfaces are needed to provide the desired hydrodynamic bearing effect which results when lubricant is forced between the journal and the associated bearing. Improperly finished bearing surfaces may lead to premature bearing failure and can limit the load carrying capacity of the bearing.

Currently, there is increasing demand for higher control of journal bearing surfaces by internal combustion engine manufacturers as the result of greater durability requirements necessary to offer improved product warranties, the higher operating speeds at which engines (particularly in motor vehicles) are now required to sustain, and the greater bearing loads imposed through increased demand on engine structures.

Various types of microfinishing techniques are presently in use. In stone microfinishing, an abrasive stone is brought directly into contact with the surface to be machined. This process has numerous shortcomings for journal surfaces.

In another type of microfinishing process, herein referred to as conventional abrasive tape microfinishing, the part is rotated and an abrasive coated tape is brought into contact under pressure against the surface. As the part is rotated, the abrasive material reduces the roughness of the surface. In the conventional process, the tape is brought into contact with the part by pressure exerted by compressible elastomeric tools or inserts, typically made from urethane plastic compounds. This process overcomes some but not all of the disadvantages associated with stone microfinishing. Principal among disadvantages not addressed is the fact that the process does not adequately correct geometric errors in the part being microfinished, since the tool acting on the abrasive tape is a flexible and therefore, the tape conforms to the surface profile of the part which may have been inaccurately formed in prior machining operations.

Microfinishing equipment developed by the assignee of this invention, the Industrial Metal Products Corp. (IMPCO) provide a significant advancement in abrasive tape microfinishing. These machines are capable of precision microfinishing, both in terms of surface finish improvement and some aspects of geometric form control. This new generation of microfinishing equipment is referred as "Generating Bearing Quality" (GBQ) tools and processes and are encompassed by assignees U.S. Pat. Nos. 4,682,444; 5,095,663, and 5,148,636 which are hereby incorporated by reference. This new approach employs an abrasive coated film made of a polyester material such as that manufactured by the 3M Company. The film is pressed against the workpiece using rigid tools having a roughened surface such as made from honing stone material or textured metal. The surfaces are accurately formed and are substantially non-compliant. Therefore, the precisely formed configuration of the tool surface is impressed in the workpiece surface and thus certain types of geometric form errors are improved such as lobbing or other errors in circular geometry (i.e. departures from a true circle in a diametric cross-section through the part). The GBQ tooling also features a relatively large wrap-around angle or angle of engagement between the tool and workpiece which further enhances control of geometric imperfections and provides improved material removal rates. This tooling coupled with periodic reversing of the relative direction of motion between the abrasive coated film and workpiece provides the ability to remove significant amounts of material in an extremely accurate controlled manner.

Even with earlier GBQ technology, as described in the previously referenced patents, some geometric imperfections are not adequately corrected. In the processes discussed, the microfinishing tool is narrower than the length of surface to be machined and is axially stroked along the surface to generate the desired surface finish characteristics. This axial stroking produces a generally uniform material removal rate along the length of the surface.

Form imperfections in crankshaft journals (and other precision cylindrical surfaces) may include deviations along the axial length of the journal (i.e. along the central longitudinal axis of the journal referred to as "axial form errors"). For example, one axial end of the journal may have a larger diameter than the opposite end, referred to as a tapered configuration. In addition, "hour-glass" imperfections are sometimes encountered in which the axial center of the journal has a smaller diameter than the ends. An opposite form referred to as "barrelling" also occurs in which the diameter of the journal is greatest at its axial center. These types of axial form errors are not adequately addressed by currently available microfinishing machining tools and processes due to their generally uniform machining action along the axial length of the journal.

The tooling and processes according to this invention however, provide a means of improving axial form errors found in cylindrical surfaces such as bearing journals. The microfinishing tools and processes according to this invention feature a means of axially shifting the center of pressure exerted by the microfinishing tool which presses the abrasive coated film into engagement with the workpiece surface. In conventional machines, the axial pressure distribution along the face of the tool is symmetrical about the axial midpoint of the tool and is fixed. By changing the center of pressure of the tool, a controllable asymmetrical machining effect can be provided along the axial length of the workpiece surface. By creating a greater pressure closer to one axial edge of the tool, a greater material removal rate is provided in that area. Thus if the greater machining effect is caused to act where an enlarged diameter is found as occurs in a tapered journal, after microfinishing a configuration closer to a true constant diameter cylinder cylindricity or other desired configuration can be provided. Shifting of the pressure toward the opposite axial edge of the tool provides improvements in geometry for journals tapered in the opposite direction. By shifting of centers of pressure during machining hour-glass type form error can also be addressed.

In accordance with this invention, a novel microfinishing tool assembly is provided in which a shiftable or axially variable machining effect is provided. If this tool assembly is combined with in-process gauging capable of diameter measurements at various axial locations, precision in-process control can be provided which is highly adaptable to variations between parts.

Microfinishing tools and processes having the features of this invention are provided in two embodiments described herein. In the first embodiment, the pivot point of a pivot shaft which mounts a microfinishing tool shoe is mechanically changed, resulting in a shiftable center of pressure acting on the machining film. In another embodiment, an external torque is applied to the microfinishing tool shoe which also provides an axially shiftable machining effect.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIGS. 4A through 4C are diagrammatic views showing pressure distribution profiles of a microfinishing tool assembly pressing an abrasive coated film onto a journal surface being microfinished, with FIG. 4A showing a normal symmetrical pressure pattern, whereas FIGS. 4B and 4C show centers of pressure shifted to the right and left, respectively, in accordance with the teachings of this invention.

DETAILED DESCRIPTION OF THE INVENTION

Figure 1:
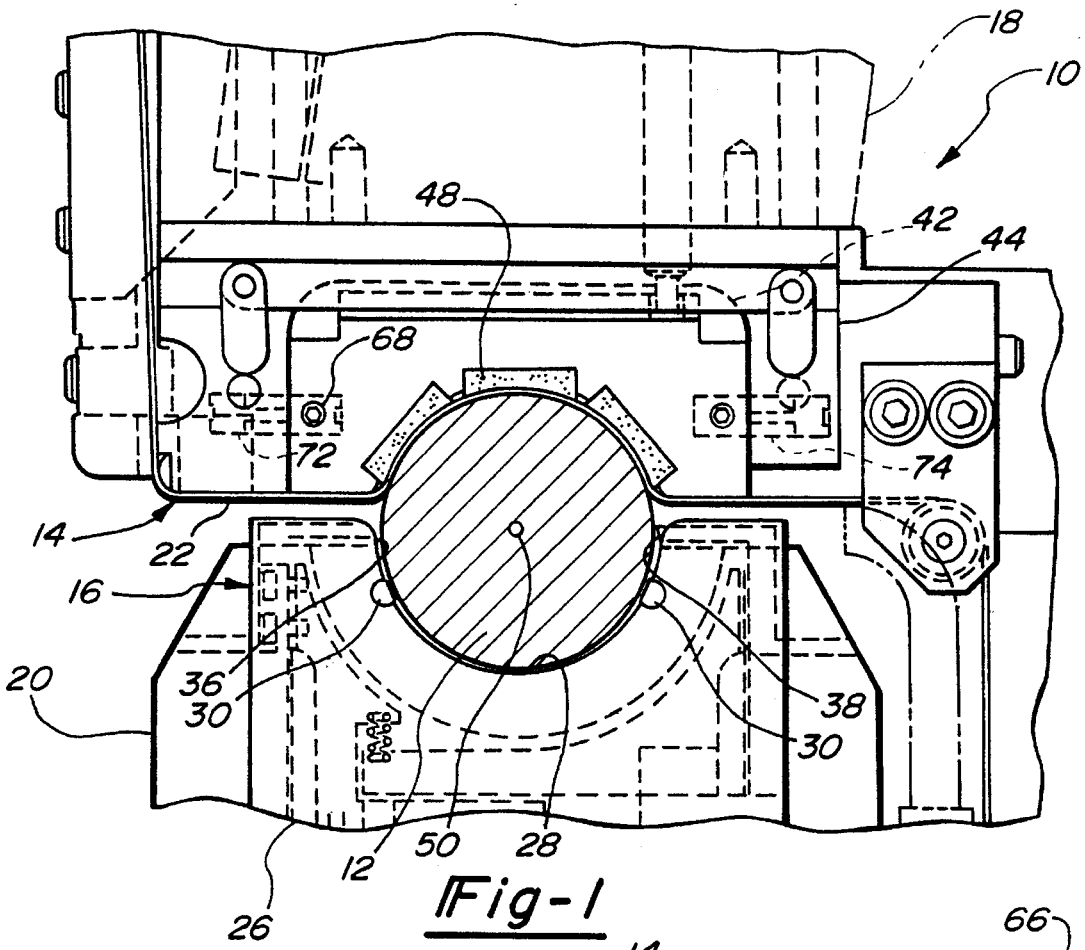
FIG. 1 is a partially cut-away elevational view of components of a microfinishing machine in accordance with the present invention showing a microfinishing tool assembly and a size control tool assembly.

Portions of a microfinishing machine according to this invention are illustrated in FIG. 1 and is generally designated by reference number 10. Microfinishing machine 10 is designed for finishing bearing journal surfaces 12 of internal combustion engine crankshafts or other cylindrical workpieces. Machine 10 includes a pair of tool or shoe assemblies including microfinishing tool assembly 14, and size control shoe assembly 16. Both of the tool assemblies define semicircular apertures which engage journal 12. Tool assemblies 14 and 16 are clamped onto journal 12 through the action of a pair of machine arms 18 and 20. A strip of abrasive coated film 22 is pressed against journal 12 by microfinishing tool assembly 14. A crankshaft (or other workpiece) having journal 12 is mounted to machine 10 by a headstock and tailstock (not shown) which support and drive the crankshaft to rotate, which causes journal 12 to rotate with respect to tool assemblies 14 and 16. This relative movement causes abrasive coated film 22 to abrade the outer surfaces of journal 12 thus performing the microfinishing operation.

Figure 14:
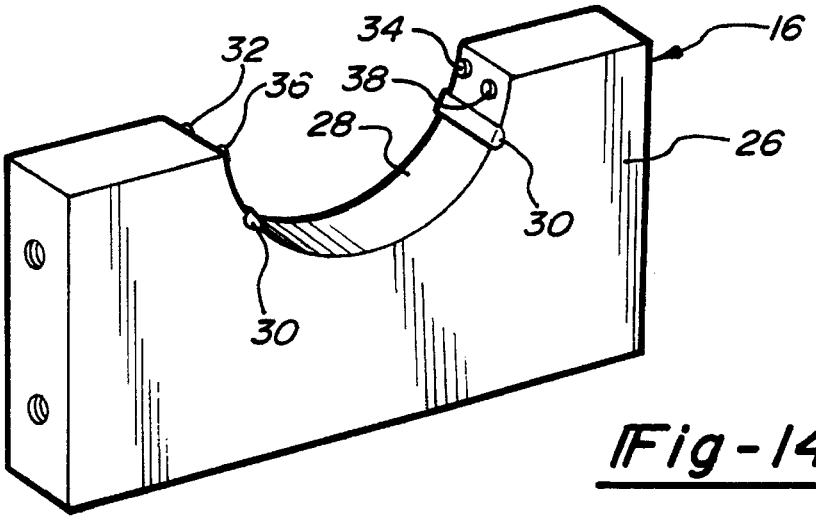
FIG. 14 is a pictorial view of a size control tool assembly used with the microfinishing tool assembly of this invention.

Microfinishing machine 10 provides for in-process control since the geometric characteristics of journal 12 are constantly monitored by size control tool assembly 16 shown in FIGS. 1 and 14. Through an electronic controller (described later) the machining operation can be controlled to generate a precise geometric configuration of the finished journal 12. Once machining is completed, relative motion between the journal 12 and microfinishing tool assembly 14 can be stopped. In the typical case, however, where multiple bearing journals are being machined simultaneously by a multiplicity of the tool assemblies shown in FIG. 1, a desired diameter for a particular journal may be reached before microfinishing operation is complete for other journals. In such cases the clamping force exerted by support arms 18 and 20 for a particular journal can be relieved, thus substantially diminishing the material removal rate of that journal while allowing other journals to be effectively machined. This process is described in the Assignees issued U.S. Pat. No. 5,148,636.

As shown in FIG. 14, size control tool assembly 14 includes a housing 26 which defines an arcuate aperture 28 which receives journal 12. Within aperture 28 are a pair of hardened metal support pads 30 which engage journal 12. Support pads 30 are made from a extremely hard material such as cemented carbide or other ceramic or diamond materials. Support pads 30 are shown separated circumferentially about the journal which is desired to provide a desired "wedging" effect which aids in maintaining size control tool assembly 16 in engagement with journal 12 during the machining operation. This is especially of concern where crankshaft rod or pin journals are being machined since both tool assemblies 14 and 16 must follow the journal through its orbital motion path. As best shown in FIG. 14, size control tool assembly 16 features a series of four probe tips. Probe tips 32 and 34 are positioned diametrically opposite and measure the diameter of journal 12 at a particular axial position along the central longitudinal axis 50 of formation of journal 12. Probe tips 36 and 38 are also diametrically oppositely positioned and measure the journal diameter at a displaced axial position as compared with that measured by probe tips 32 and 34. By providing two pairs of axially separated probe tips, axial form errors in the workpiece can be evaluated such as tapering, lobbing or "hour-glass" configurations which were described previously. In some applications, it may be desirable to provide three (or more) sets of probe tips to provide more detailed profile information. Size control tool assembly 16 is bolted to arm 20 and is shown in diagrammatic fashion in the Figures. A more specific disclosure of the configuration of a size control tool assembly 16 can be had with reference to Assignees previously issued U.S. Pat. No. 5,095,663.

Figure 2:
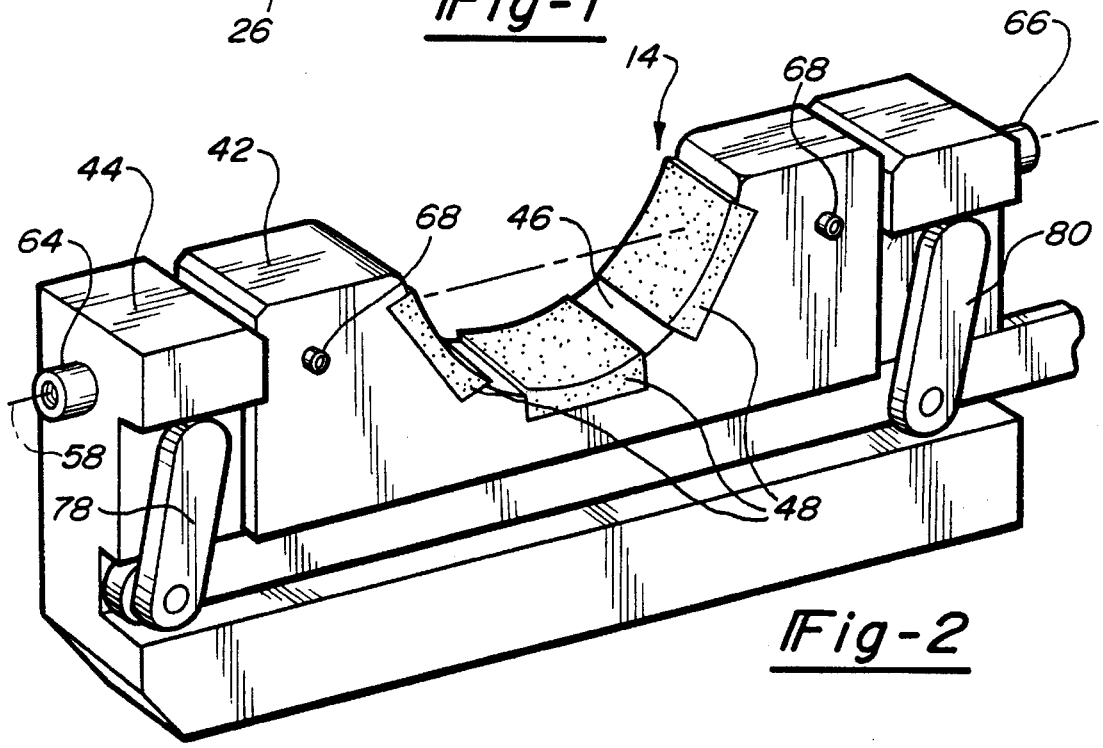
FIG. 2 is a isometric view of the microfinishing tool assembly as shown in FIG. 1.

Microfinishing tool assembly 14 as shown in FIG. 2 comprises two primary components; namely, microfinishing housing or shoe 42 and tool hanger 44. Microfinishing shoe 42 defines a semi-circular aperture 46 and further includes three rigid inserts 48 formed from a hard material such as honing stone material or a metal carbide, diamond having a roughened surface. Microfinishing shoe 42 is designed to provide the numerous benefits of Assignees new generation "GBQ" microfinishing tooling.

Figure 3:
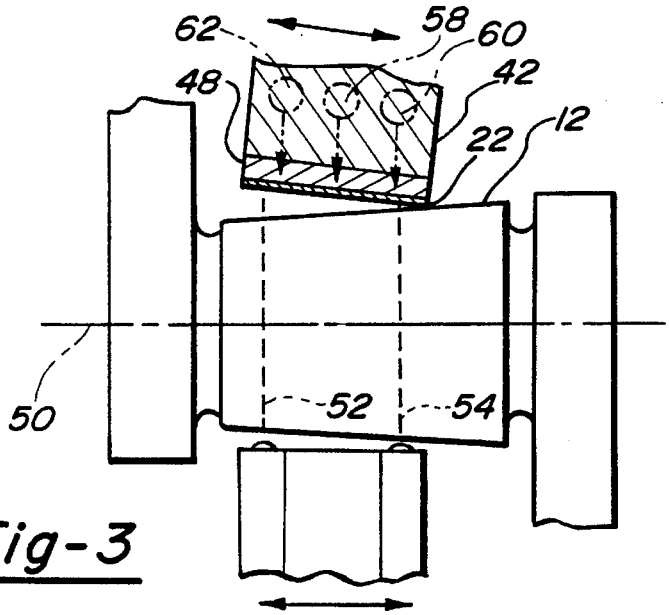
FIG. 3 is a diagrammatic view of a crankshaft journal having an exaggerated tapered configuration showing engagement of the microfinishing tool assembly and size control tool assembly.

Now with reference to FIG. 3, a portion of an internal combustion engine crankshaft having journal 12 is shown having an exaggerated tapered configuration. As shown in the Figure the diameter of journal 12 is larger at its right-hand end along axis 50 as compared with its left-hand end. Microfinishing shoe 42 is shown in section pressing abrasive coated film 22 against the journal surface. Similarly, size control tool 16 is shown (out of polar position for the sake of illustration) engaging journal 12 and providing diameter measurements about axially displaced planes 52 and 54. In operation, during microfinishing, tool assemblies 14 and 16 are oscillated along the surface of journal 12 as indicated by the double-headed arrows of FIG. 3.

Figure 4A:
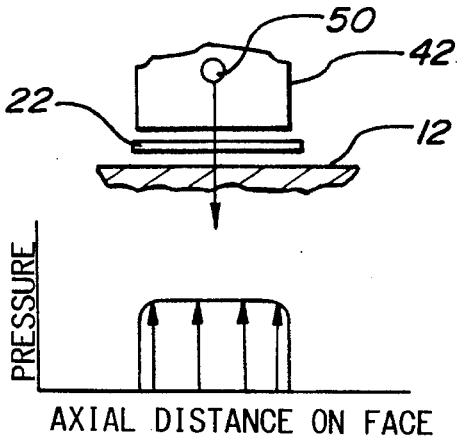

In prior art microfinishing tool assemblies, the microfinishing shoe pivots relative to the tool hanger about an axis 58 as shown in FIG. 2. Thus shoe 42 is allowed to pivot slightly, enabling the shoe to self-align with the surface of journal 12. This location of pivoting is shown in FIG. 3, at pivot axis 58. FIG. 4A shows the effect of this pivoting action. As shown in FIG. 4A the pressure exerted by shoe 42 against the journal surface is at the axial center of the microfinishing shoe. FIG. 4A shows an idealized pressure distribution against the workpiece exerted by the shoe pressing abrasive coated film 22 axially along its face. As shown, the pressure profile is symmetrical, providing an approximately uniform force distribution across the entire surface. This location of pivoting and center of pressure is desirable where a uniform reduction in diameter of the journal along its axial length is desired. However, for the journal shown in FIG. 3, such a positioning would uniformly reduce the journal diameter along its axial length and thus the originally tapered journal would remain tapered after machining, although its diameter would be uniformly reduced.

Figure 4B:
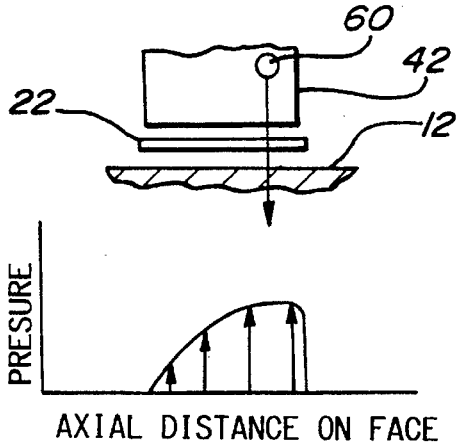
Figure 4C:
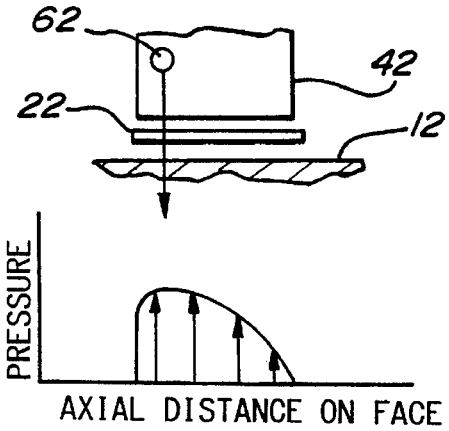

In accordance with this invention, techniques for shifting the machining effect of microfinishing shoe 42 axially along its face is provided. The effect of such shift is illustrated with reference to FIGS. 3, 4B and 4C. If the pivot axis of microfinishing shoe 42 is right-shifted as indicated at 60 in FIG. 3, a shift in the pressure distribution to the right is provided as illustrated in FIG. 4B. This shift in pressure distribution occurs since the shoe 42 assumes a condition of static equilibrium with respect to rotation about the pivot axis. With a greater machining effect provided at the right-hand portion of shoe 42 a greater reduction in diameter is provided at that location which provides a means of eliminating or reducing the extent of the tapered configuration shown in FIG. 3. If journal 12 were tapered in the opposite sense, i.e. the left-hand end having a greater diameter than the right-hand end, the pivot location designated at 62 could be used which is illustrated in FIG. 4C.

Figure 12:
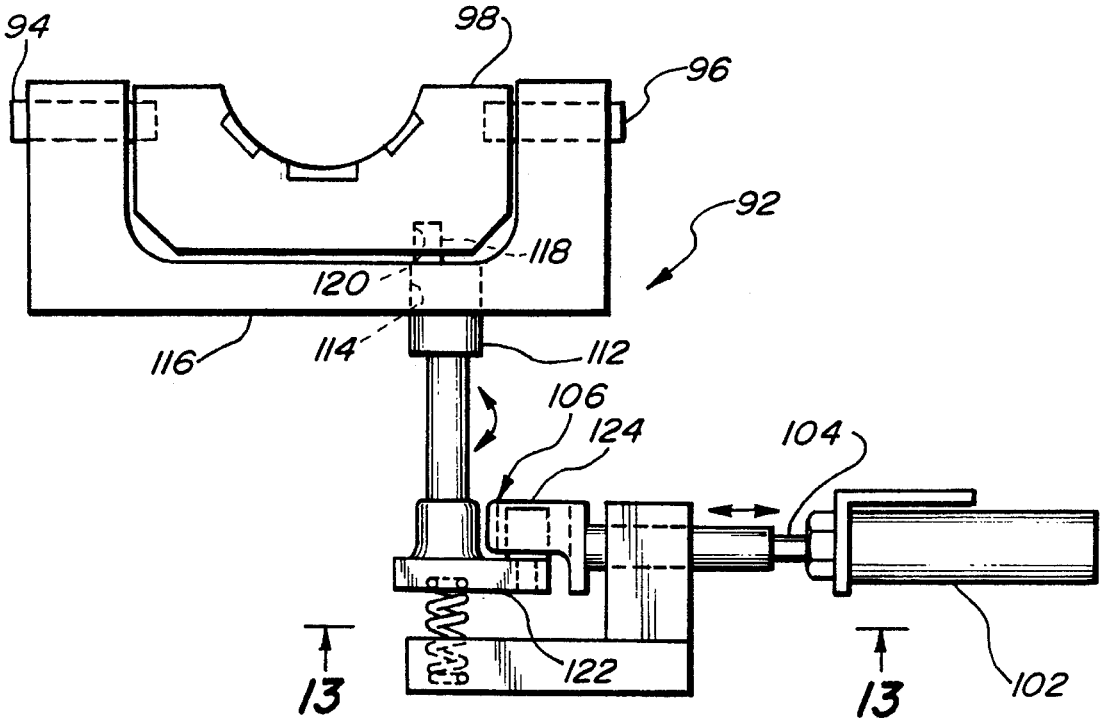
FIG. 12 is a pictorial view of a microfinishing tool assembly according to the second embodiment of this invention.
Figure 13:
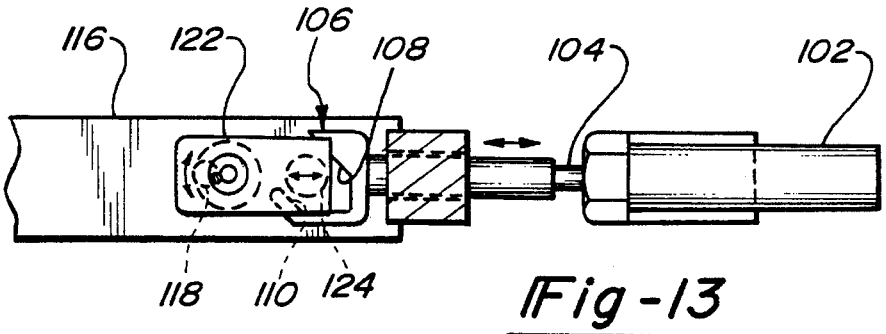
FIG. 13 is a cross-sectional view taken along line 13—13 from FIG. 12.

Various approaches toward providing an axially adjustable machining effect can be implanted. Two such embodiments are hereinafter disclosed in this specification. A first approach is shown in detail with reference to FIGS. 2, and 5 through 11 which involves a shiftable pivot axis. A second approach is shown by FIGS. 12 and 13 in which external forces are exerted to modify the machining effect.

Tool hanger 44 incorporates a pair of specially formed pivot shafts 64 and 66 which fit within blind bores within microfinishing shoe 42, and are fixed within the shoe bores through insertion of roll pins 68. Pivot shafts 64 and 66 also extend through aligned bores 72 and 74 through tool hanger 44 where they are free to rotate. Pivot shafts 64 and 66 have ground flats 65 and 67 positioned within the bores 72 and 74. Shift linkage bar 76 is pinned to a pair of arms 78 and 80 and thus defines a parallel four bar linkage arrangement. Arms 78 and 80 are capable of shifting between three positions; a neutral position in which the arms are vertical and two positions in which the arms are shifted counter-clockwise and clockwise from the vertical orientation. The effect of such shifting is to change the pivot axis location providing the effects previously described with reference to FIGS. 4B and 4C.

Figure 11:
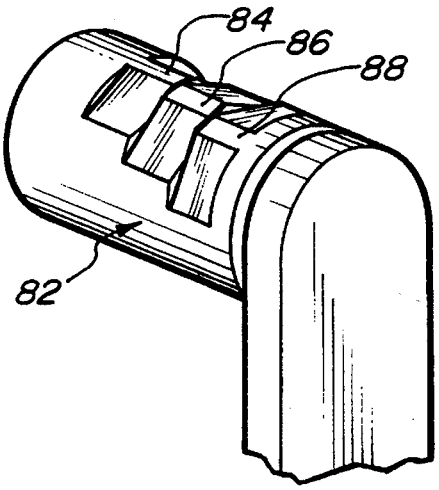
FIG. 11 is a partial isometric view of the pivot post of the tool hanger of this invention.

Each of pivot arms 78 and 80 include cam posts 82, best shown with reference to FIG. 11. Cam post 82 defines three axially separated and angularly indexed lands 84, 86 and 88 defined by removing material from the cylindrical posts as shown in FIG. 11. These lands interact with pivot shafts 64 and 66 to provide the shifting pivot axis capability previously described.

Figure 5:
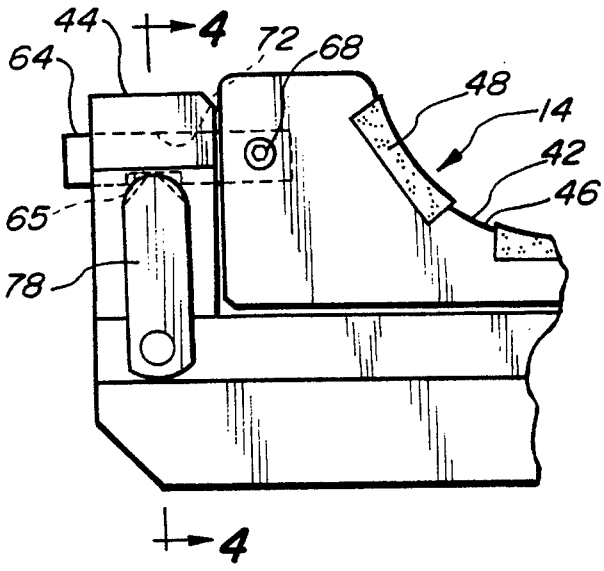
FIG. 5 is a partial elevational view of the microfinishing tool assembly according to this invention showing the tool shoe in a normal condition.
Figure 6:
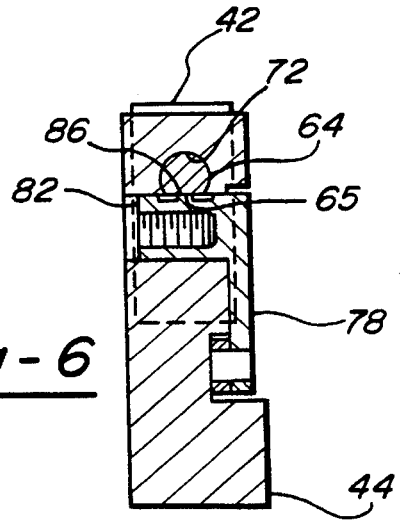
FIG. 6 is a cross-sectional view taken along line 6—6 of FIG. 5.

FIG. 5 shows a neutral orientation for microfinishing shoe 42. In that position, arms 78 and 80 are vertical. As shown in FIG. 6, in this position, land 86 engages flats 65 and 67 of pivot shafts 64 and 66. In this configuration, lands 86 engage the flats at their midpoints and consequently a pivot position symmetrically positioned axially along the face of microfinishing shoe 42 is provided, which corresponds with pivot axis location 58 of FIG. 2. This is the condition used where a uniform reduction in diameter along the axial length of journal 12 is desired. In this condition, microfinishing tool assembly 14 operates like previously available microfinishing equipment manufactured by the Assignee.

Figure 7:
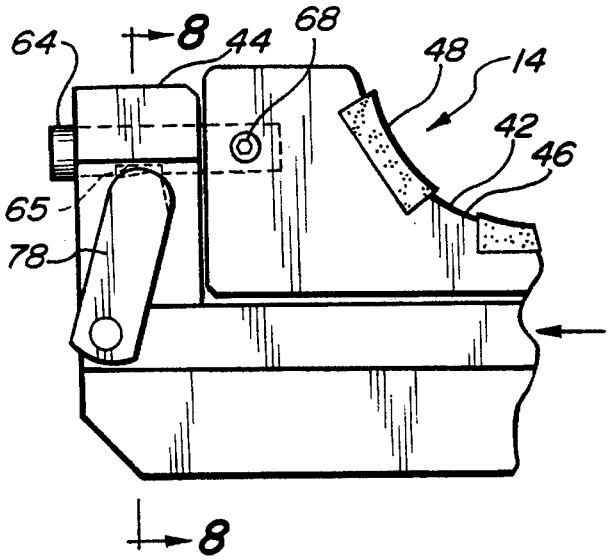
FIG. 7 is a partial elevational view of the microfinishing tool assembly showing a right-shifted pivot axis for the tool shoe.
Figure 8:
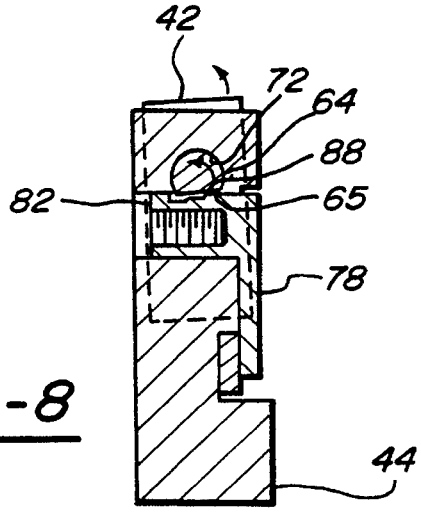
FIG. 8 is a cross-sectional view taken along line 8—8 of FIG. 7.

In the event that a tapered journal 12 surface is encountered, the orientation of the elements shown in FIGS. 7 through 10 can be provided. In FIG. 7, arms 78 and 80 are both shifted in a clockwise direction and pivot shaft flats 65 and 67 rest on land 88, which as shown in FIG. 8 engages the flats to the right of their centers. This configuration thus produces a shifted effective pivot axis location as shown by pivot axis 60 of FIG. 3. This orientation would address the tapering situation illustrated in FIG. 3, where its right-hand journal end is of larger diameter than the left-hand end.

Figure 9:
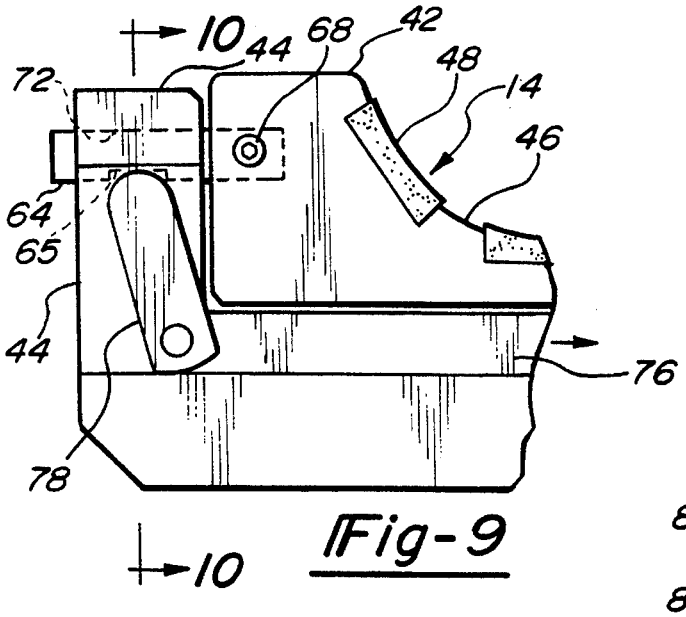
FIG. 9 is a partial elevational view of a microfinishing tool assembly showing a left-shifted pivot axis for the tool shoe.
Figure 10:
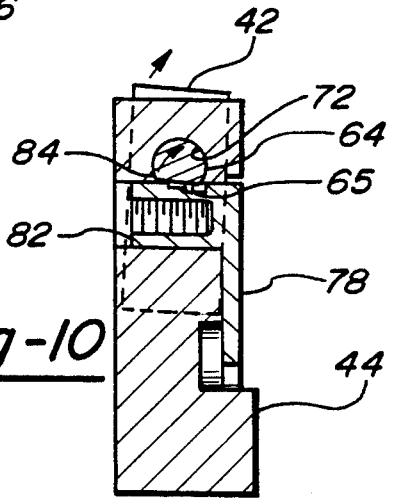
FIG. 10 is a cross-sectional view taken along line 10—10 of FIG. 9.

If an opposite tapering condition is encountered, the arms 78 and 80 are shifted in a counter-clockwise direction as shown in FIG. 9. This orientation brings land 84 into engagement with the pivot shaft flats 65 and 67 which shifts the effective pivot axis to the left as designated at 62 in FIG. 3. Accordingly, by appropriately positioning arms 78 and 80, the effective pivot axis of the microfinishing shoe 42 can be varied in accordance with variations in geometry which occur along the axial length of the workpiece.

Microfinishing machine 10 in accordance with this invention is further capable of correcting axial form errors such as an hour-glass configuration by shifting the pivot axis during the machining operation. By first shifting the pivot axis to one side of center for a series of axial strokes, and then shifting it in the opposite direction, a greater average material removal rate at the axial ends is provided as compared with the axial center of the journal. This type of operation may also be desirable even where a workpiece does not initially have a hour-glass shape. It has been found that during the microfinishing operation the axial center of a journal reaches a higher temperature than do the ends as a result of the machining action. The lower temperatures at the ends is attributed to the shorter more efficient conduction path of heat to the remainder of the crankshaft. This increased temperature at the center causes non-uniform thermal expansion and thus the journal surface bulges at its center which accordingly produces a higher material removal rate there (i.e. bulging center is machined away as if it were a form error). Subsequent to the machining operation, when the journal cools to a uniform temperature the center shrinks, producing an hour-glass configuration. In accordance with this invention, by shifting the machining action from one side of center to the other, an intentional barrel shape profile can be produced during machining, which after processing, results in a more uniform cylindrical surface.

Another embodiment for producing an axially variable machining effect in accordance with this invention is illustrated in FIGS. 12 and 13. Microfinishing tool assembly 92 includes a pair of pivot shafts 94 and 96 which are cylindrical in configuration and which are not directly acted upon to produce a change in their effective pivot axis location. Instead, an external torsional loading is placed upon microfinishing shoe 98 which shifts the effective center of pressure which would otherwise be in equilibrium at the neutral position illustrated in FIG. 4A.

An external torsional loading can be placed on microfinishing shoe 98 in a variety of manners. In the embodiments shown in FIGS. 12 and 13, a fluid actuated cylinder 102 is actuated in two directions in a controllable fashion (i.e. double acting). The rod 104 of cylinder 102 is connected to cam 106 which has a pair of inclined cam surfaces 108 and 110. Post 112 is journalled within a bore 114 of tool hanger 116. A pin 118 extending from post 102 engages bore 120 within microfinishing shoe 98. At the opposite end of post 112 an arm 122 is provided with a protruding crank pin 124 which is trapped within cam 106 of the rod having inclined surfaces 108 and 110. When cylinder 102 is activated to move rod 104 to the right most position, inclined surface 110 engages crank pin 124 which places a counter-clockwise force on arm 122 which in turn is imparted onto microfinishing shoe 98 which biases it about pivot pin 94 and 96. An opposite bias occurs as the cylinder rod 104 is extended to move to the left causing engagement between pin 124 and inclined surface 108. These externally imposed torsional loads on the microfinishing shoe upset the equilibrium condition which would otherwise exist which produces a generally uniform machining effect across the axial face of the microfinishing shoe. Therefore, the center of pressure and machining effect can be left shifted or right shifted, to produce the effect diagrammatically illustrated in FIGS. 4B and 4C. One attractive feature of tool assembly 92 is the ability to accurately modulate the tortional loading applied on shoe 98 by regulating the pressure applied to cylinder 102.

Figure 15:
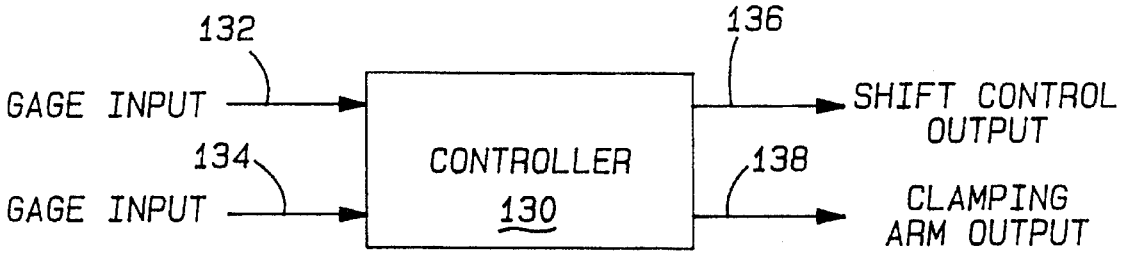
FIG. 15 is a schematic diagram of a controller for operating the machine according to this invention.

FIG. 15 shows diagrammatically a controller 130 for use with the tool assemblies of this invention. Controller 130 would preferably be a conventional programmable controller of the type in widespread use in the machine tool industry. Gage inputs 132 and 134 are diameter signals from the two sets of gage probes from size control tool assembly 16. If a diameter difference is detected, a shift signal which could be a right-shift or left-shift signal is sent on line 136. Line 136 would also carry a neutral return signal where appropriate. Once a desired diameter is reached, a signal on line 138 is sent which relieves clamping pressure exerted by machine arms 18 and 20. FIG. 15 is strictly diagrammatic. Appropriate interface devices and programming techniques would be implemented in carrying out this invention as well known to those skilled in the field.

While the above description constitutes the preferred embodiments of the present invention, it will be appreciated that the invention is susceptible of modification, variation and change without departing from the proper scope and fair meaning of the accompanying claims.

I claim:

1. A microfinishing tool assembly for machining an external cylindrical surface of a workpiece using a machine of the type using a flexible abrasive coated microfinishing film which is pressed against said workpiece surface by said tool assembly as said workpiece and said film are moved relative to one another, said tool assembly comprising:

a shoe defining an aperture for engaging said workpiece and having a shoe surface for pressing said film against said workpiece surface, said shoe surface wrapping around a portion of the perimeter of said workpiece surface and extending axially in the direction of the longitudinal center axis of said workpiece surface, and machining control means for causing the center of pressure applied by said shoe surface distributed axially along said shoe surface to be moveable axially along said shoe surface.

2. The microfinishing tool assembly according to claim 1 wherein said shoe surface is formed of a rigid substantially incompressible material and wherein said microfinishing film is formed of a polyester plastic material.

3. The microfinishing tool assembly according to claim 1 wherein said shoe surface is formed of honing stone material.

4. A microfinishing tool assembly according to claim 1 wherein said tool assembly further comprises a tool hanger for mounting said shoe and pivot means for coupling said tool hanger and said shoe allowing pivoting motion about a pivot axis perpendicular to said workpiece cylindrical surface.

5. A microfinishing tool assembly according to claim 4 wherein said machining control means causes said pivot axis to be moved axially with respect to said longitudinal center axis of said shoe surface.

6. A microfinishing tool assembly according to claim 5 wherein said pivot means comprises at least one pivot shaft which is fixed to said shoe and is pivotable with respect to said hanger, said pivot shaft defining a flattened surface and said hanger having a cam which is shiftable to change the point of contact between said cam and said pivot shaft thereby shifting axially said pivot axis.

7. A microfinishing tool assembly according to claim 4 wherein said machining control means comprises means for applying an external torque onto said shoe about said pivot axis.

8. A microfinishing tool assembly according to claim 7 wherein said means for applying an external torque comprises a shaft journaled to said tool hanger having an eccentric pin which engages said shoe and urges said shoe to rotate about said pivot axis.

9. A microfinishing tool assembly according to claim 1 further comprising a size control tool assembly for providing diameter measurements of said workpiece surface at two axially separated planes perpendicular to said longitudinal center axis.

10. A microfinishing machine for machining an external cylindrical surface of a workpiece using a flexible abrasive coated microfinishing film which is pressed against said workpiece surface as said workpiece and said film are moved relative to one another, said machine comprising:

a microfinishing tool assembly having a shoe defining an aperture for engaging said workpiece and having a shoe surface for pressing said film against said workpiece surface, said shoe surface wrapping around a portion of the perimeter of said workpiece surface and extending axially in the direction of the longitudinal central axis of said cylindrical workpiece surface, a gaging tool assembly having probe means for simultaneously measuring the physical characteristics of said workpiece surface at two axially separated planes normal to said longitudinal central axis thereby allowing differences in said workpiece surface along said longitudinal axis to be measured, and machining control means for causing the center of pressure applied by said microfinishing tool assembly distributed axially along said shoe surface to be moved axially along said shoe surface.

11. The microfinishing machine according to claim 10 wherein said shoe surface of said microfinishing tool assembly is formed of a rigid substantially incompressible material and wherein said microfinishing film is formed of a polyester plastic material.

12. The microfinishing machine according to claim 11 wherein said shoe surface is formed of honing stone material.

13. The microfinishing machine according to claim 10 wherein said microfinishing tool assembly further comprises a tool hanger for mounting said shoe and pivot means for coupling said tool hanger and said shoe allowing pivoting motion about a pivot axis perpendicular to the longitudinal central axis of said workpiece cylindrical surface.

14. A microfinishing machine according to claim 10 wherein said machining control means causes said pivot axis to be moved axially with respect to said longitudinal center axis of said shoe surface.

15. A microfinishing machine according to claim 13 wherein said pivot means comprises at least one pivot shaft which is fixed to said shoe and is pivotable with respect to said tool hanger, said pivot shaft defining a flattened surface and said tool hanger having a cam which is shiftable to change the point of contact between said cam and said pivot shaft thereby shifting axially said pivot axis.

16. A microfinishing machine according to claim 10 wherein said machining control means comprises means for applying an external torque onto said shoe about said pivot axis.

17. A microfinishing machine according to claim 16 wherein said means for applying an external torque comprises a shaft journaled to said tool hanger having an eccentric pin which engages said shoe and urges said shoe to rotate about said pivot axis.

18. A method of microfinishing an external cylindrical surface of a workpiece comprising the steps of:

providing a strip of abrasive coated microfinishing film material, providing a microfinishing tool assembly defining a tool aperture for engaging said workpiece and having a tool surface for pressing said film against said workpiece surface, said tool surface wrapping around the perimeter of said workpiece and extending axially in the direction of the central longitudinal axis of said cylindrical workpiece surface, providing a gaging tool assembly having probe means for simultaneously measuring the physical characteristics of said workpiece surface at two different axially separated planes normal to said longitudinal central axis allowing diameter differences in said workpiece surface along said workpiece surface to be measured, providing machining control means for causing the center of pressure applied by said shoe surface distributed axially along said shoe surface to be moveable axially along said shoe surface, and controlling said machining control means in response to said measuring by said gaging tool assembly.

19. A method of microfinishing according to claim 18 wherein said microfinishing tool assembly is pivotable about a pivot axis perpendicular to the center longitudinal axis of said workpiece surface and said means for adjusting compromises moving the position of said pivot axis with respect to said tool surface.

20. A method of microfinishing according to claim 18 wherein said microfinishing tool assembly is pivotable about a pivot axis and said means for adjusting compromises applying a torque to said tool assembly urging said tool assembly to rotate about said pivot axis.

* * * * *